US012150539B1

(12) United States Patent
Mellen et al.

(10) Patent No.: US 12,150,539 B1
(45) Date of Patent: Nov. 26, 2024

(54) SINGLE-BAG PACK FOR EVERYDAY CARRY AND FOR TRAVEL

(71) Applicant: ParsonsKellogg, LLC, East Providence, RI (US)

(72) Inventors: Charles S Mellen, Barrington, RI (US); Martin Demian Wahl, Portland, OR (US); Charles J Clifford, New York, NY (US); Lawrence J Lein, Alpine, NY (US)

(73) Assignee: ParsonsKellogg, LLC, East Providence, RI (US)

( * ) Notice: Subject to any disclaimer, the term of this patent is extended or adjusted under 35 U.S.C. 154(b) by 1155 days.

(21) Appl. No.: 15/944,388

(22) Filed: Apr. 3, 2018

(51) Int. Cl.

| | |
|---|---|
| ***A45F 3/04*** | (2006.01) |
| ***A45C 5/06*** | (2006.01) |
| ***A45C 7/00*** | (2006.01) |
| ***A45C 13/02*** | (2006.01) |
| *A45F 3/00* | (2006.01) |

(52) U.S. Cl.
CPC ..... *A45F 3/04* (2013.01); *A45C 5/06* (2013.01); *A45C 7/0027* (2013.01); *A45C 13/02* (2013.01); *A45C 2013/025* (2013.01); *A45F 2003/003* (2013.01)

(58) Field of Classification Search
CPC ..... A45F 3/04; A45F 2003/003; A45C 5/06; A45C 7/0027; A45C 13/02; A45C 2013/025
See application file for complete search history.

(56) References Cited

U.S. PATENT DOCUMENTS 5,209,384 A * 5/1993 Anderson ..... A45C 13/02 224/223
5,706,992 A * 1/1998 Moor ..... G06F 1/1628 190/102
5,799,851 A * 9/1998 Wulf ..... A45C 7/0045 224/580

(Continued)

OTHER PUBLICATIONS

"Aer Travel Pack Review One Bag Travel", One Bag Travel—Pack Hacker, 2017, 16 Pages.

(Continued)

*Primary Examiner* — Corey N Skurdal
(74) *Attorney, Agent, or Firm* — Patent GC LLC

(57) ABSTRACT

A single-bag pack for carrying business and travel items together includes a harness for carrying the pack on one's back; a travel compartment having a suitcase-opening lid to which the harness is attached; a personal items compartment; and a computer compartment within one of the suitcase-opening lid and a wall separating the travel compartment from the personal items compartment; the travel compartment, the personal items compartment, and the computer compartment each inaccessible from within each other of the travel compartment, the personal items compartment, and the computer compartment. More generally, the pack may include a first compartment having a first lid, the first compartment constructed and arranged to be expandable and the be substantially invisible when not expanded; a slender compartment built into the first lid opening outside the first lid; and a second compartment having a second lid accessible from outside the first compartment and the slender compartment.

20 Claims, 7 Drawing Sheets

(56) References Cited

U.S. PATENT DOCUMENTS

| | | | | |
|---|---|---|---|---|
| 6,053,382 | A * | 4/2000 | Wyant | A45C 7/0068 190/103 |
| 6,305,587 | B1 | 10/2001 | Miller | |
| 6,530,507 | B2 | 3/2003 | Oh | |
| 7,021,437 | B2 * | 4/2006 | Ghiassi | A45C 7/0022 190/103 |
| 8,522,939 | B2 * | 9/2013 | Rowe | A45C 3/00 190/109 |
| 9,687,062 | B2 | 6/2017 | Scicluna | |
| 10,258,130 | B2 | 4/2019 | Janzen | |
| 10,368,619 | B2 | 8/2019 | Richards et al. | |
| 10,463,124 | B2 | 11/2019 | Richards et al. | |
| 11,839,288 | B2 | 12/2023 | Durham et al. | |
| 2007/0045071 | A1 * | 3/2007 | Gorga | A45C 7/0027 190/103 |
| 2009/0206118 | A1 * | 8/2009 | Sabbah | A45C 13/02 224/652 |
| 2020/0037719 | A1 | 2/2020 | Jaworski et al. | |

OTHER PUBLICATIONS

"Booq Pack Pro Business-Friendly MacBook Backpack", booqbags, 2018, 4 Pages.
"eBags TLS Professional Weekender Bag-Review", Dec. 1, 2014, 6 Pages.
"Gregory Border 35 L", eBags, 2018, 8 Pages.
"High Sierra AT8 Convertible Carry-On", eBags, 2018, 9 Pages.
Chan, M., "Nomatic Travel Pack Review", Pangolins with Packs, Feb. 13, 2018, 18 Pages.
"Review: Pacsafe Venturesafe EXP65 Travel Backpack", Gap Year Travel Blog, Oct. 24, 2017, 14 pages.
"Samsonite Pro 4 DLX Urban Backpack PFT", eBags, 2018, 10 Pages.
"Command Backpack", Timbuk2, 2018, 10 Pages.
"TLS Professional Weekender", Lifeboat Edtition, eBags, 2018, 9 Pages.
Jeffries, K., "Incase EO Travel Backpack Review: The Search for the Perfect Carry-On", Nov. 13, 2015, 4 Pages.

* cited by examiner

SINGLE-BAG PACK FOR EVERYDAY CARRY AND FOR TRAVEL

BACKGROUND

For everyday use, members of today's society carry day packs or computer bags that are tailored for carrying office-related and other items for everyday use. Those items may include a laptop computer, tablet, pens and paper, phone, and other items. When the same folks travel, they sometimes resort to stuffing clothing into their day packs, sometimes use a carry-on bag alongside their day pack, or may use another type of bag that combines a compartment large enough for clothing with other compartments for everyday carry items. These conventional solutions to everyday carry and travel carry have various problems unforeseen by their proponents but discovered and solved by the present inventors.

SUMMARY

The invention includes a single-bag pack for carrying everyday business and travel articles together, including a separate travel compartment having a first lid to which backpack straps are attached. In embodiments where the first lid is a suitcase-opening lid, the backpack straps are oriented such that the hinge of the suitcase-opening lid is substantially vertical when carried on the back of a user. Other opening types can be used in place of the first lid in other embodiments. The travel compartment is itself compressible to occupy a negligible volume relative to a volume occupied by the pack as a whole when the travel compartment is not in use. The travel compartment may be compressed by a perimeter zipper or any other suitable compression means as may be desired. The pack further includes a business/personal compartment appended to a panel of the travel compartment opposite the first lid. In some embodiments, the business/personal compartment may have a clamshell-opening lid oriented for loading the business/personal compartment from the top when oriented as carried as a backpack, although other opening types and orientations are also within the scope of the invention. The pack yet further includes a computer compartment having a minimal thickness disposed either in the suitcase-opening lid or in a wall between the travel compartment and the business/personal compartment.

A travel compartment having a suitcase-opening lid to which backpack straps are attached, and a business/personal compartment dependent from a wall of the travel compartment opposite the suitcase-opening lid permits the travel compartment to effectively disappear when compressed, provides for the weight of the user's laptop computer to be carried as close to the body as possible, and provides for proper support and balance to the pack while carrying a laptop computer when used for travel or other everyday carry situations.

A single-bag pack for carrying business and travel items together includes a harness for carrying the pack on one's back; a travel compartment having a first lid to which the harness is attached; a personal items compartment; and a computer compartment within one of the first lid and a wall separating the travel compartment from the personal items compartment; the travel compartment, the personal items compartment, and the computer compartment each inaccessible from within each other of the travel compartment, the personal items compartment, and the computer compartment. In a variation, the travel compartment is expandable by use of an expansion zipper joined by an expansion gusset. In a further variation, the expansion zipper is hidden beneath a flap of material when the expansion zipper is closed. In an alternate variation, the suitcase-opening lid remains able to open when the travel compartment is compressed. In another alternate variation, the pack includes a tuck-away compartment in the lid into which the harness can be tucked. In yet another alternate variation, the pack includes an accessory compartment.

More generally, a single-bag pack for carrying business and travel items together includes a first compartment having a first lid, the first compartment constructed and arranged to be expandable and to be substantially invisible when not expanded; a slender compartment built into the first lid opening outside the first lid; and a second compartment having a second lid accessible from outside the first compartment and the slender compartment. In a variation, the pack further includes a harness for carrying the pack on one's back attached to the first lid.

In the following description reference is made to the accompanying drawings, which form a part hereof, and in which are shown example implementations. It should be understood that other implementations are possible, and that these example implementations are intended to be merely illustrative.

DETAILED DESCRIPTION

Figure 1:
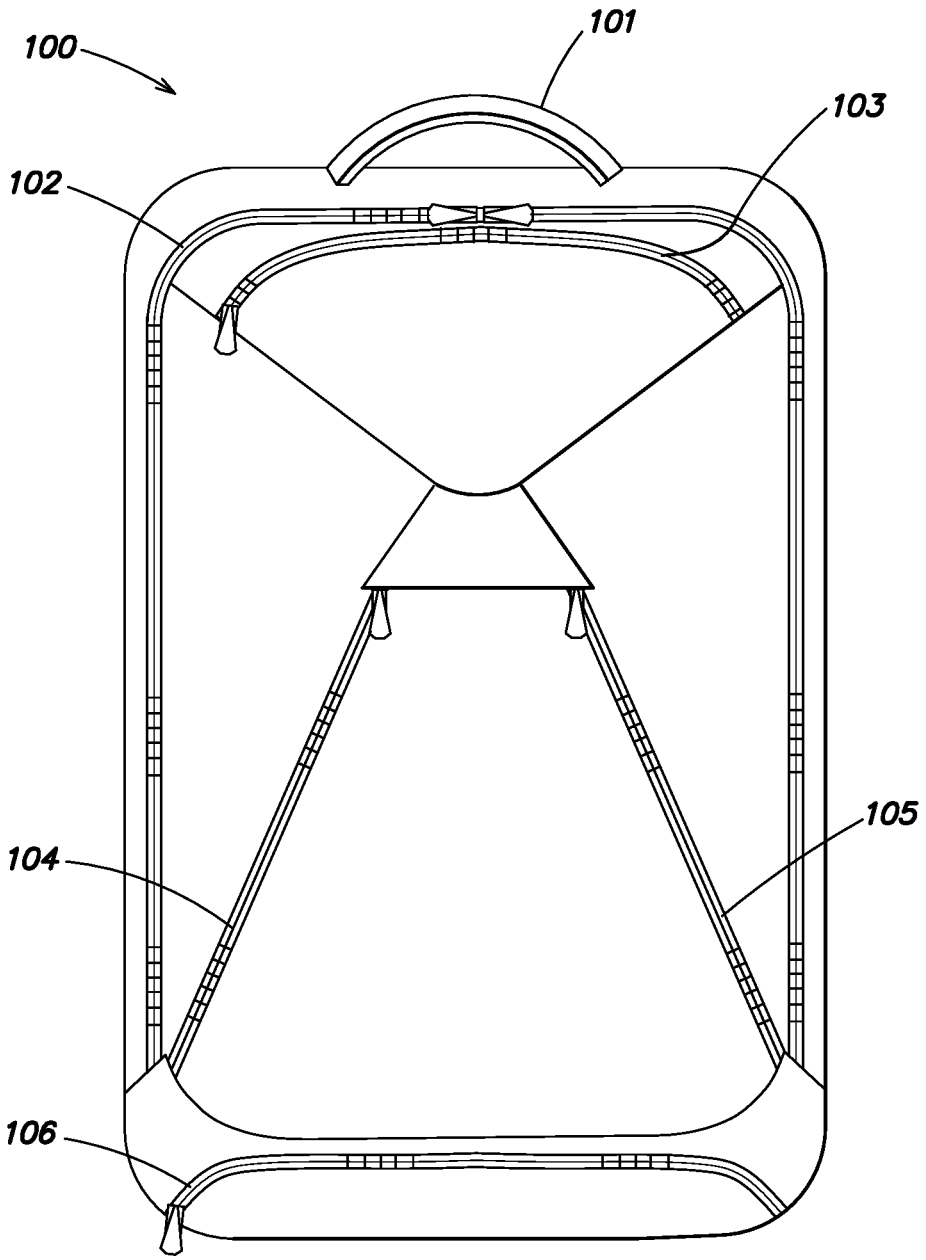
FIG. 1 is front view of a pack according to the invention.

The following section illustrates the invention through a detailed description of an exemplary embodiment and variations thereof.

A suitcase-opening lid is, for the purposes of this description, one type of lid for an item of luggage such as a suitcase, pack, brief case or the like. On an item of luggage having plural generally rectangular sides, it is one of two larger panels and is most often hinged on a long edge of the item; the other large panel forming a base on which the item rests while being loaded with articles to carry. A suitcase-opening lid swings completely out of the way of the compartment top for easy loading.

A clam-shell opening lid, for the purposes of this description, is another type of lid for an item of luggage such as a suitcase, pack, brief case or the like. On an item of luggage having plural generally rectangular sides, it is also one of two larger panels and is most often hinged on an edge of the item other than the longest; a smallest panel of the item usually forming a base on which the item rests while being loaded with articles to carry. A clam-shell opening lid covers a vertical side of the compartment to which it provides access and may be hinged and/or gusseted to open only part-way, allowing the compartment to be loaded from the top.

Other lids and openings that can be used in connection with combinations forming the invention include a U-shape opening, a slash-zipper opening (such as found on duffle bags, and which can be placed on a top surface or front surface of a pack), a drawstring opening, a flap closure (with optional buttons, snaps, buckles, straps, magnets, weights, etc.), and others. Lids, openings, and fastenings can be combined, such as in the case of a drawstring opening covered by a flap with buckles.

A single-bag pack suitable both for everyday carry and for travel according to the invention is now described in connection with the drawing (FIGS. 1-6).

FIG. 1 illustrates a single-bag pack 100 having plural compartments. The pack includes a handle 101 by which it may be hand-carried. This view shows several clam-shell openings for compartments used for everyday carry items. Large zipper 102 provides access to a large compartment suitable, for example, for carrying a tablet, papers, files, and other larger, everyday carry items. Arcuate zipper 103 provides access to a small compartment suitable, for example, for frequent-access items such as sunglasses. Small zippers 104 and 105 define the sides of a clam-shell opening providing access to another small compartment suitable, for example, for small personal items such as pens, cell phone, keys, etc. The small compartments accessed through zippers 103, 104, and 105 are built into the external wall structure of the clam-shell cover accessed through zipper 102.

Also shown in this view is a bottom zipper 106 through which a small compartment built into the base of the pack is accessed. Such a compartment may be suitable, for example, for carrying infrequently-needed items such as device chargers and batteries, cables, and accessory items.

The pack may be constructed of any suitable materials for exterior durability and style, interior durability and style, and protection. Exterior materials may include nylon canvas, cotton canvas duck, polyester, leather or other durable materials; interiors may be high-denier nylon or other suitable lining materials; hard and soft padding materials may be included between layers; and carrying straps and handles may be of similar high-tensile, durable materials. Gussets may be made entirely of the liner material or may be liner material facing the inside of a compartment and exterior material facing the outside of the pack.

Figure 2:
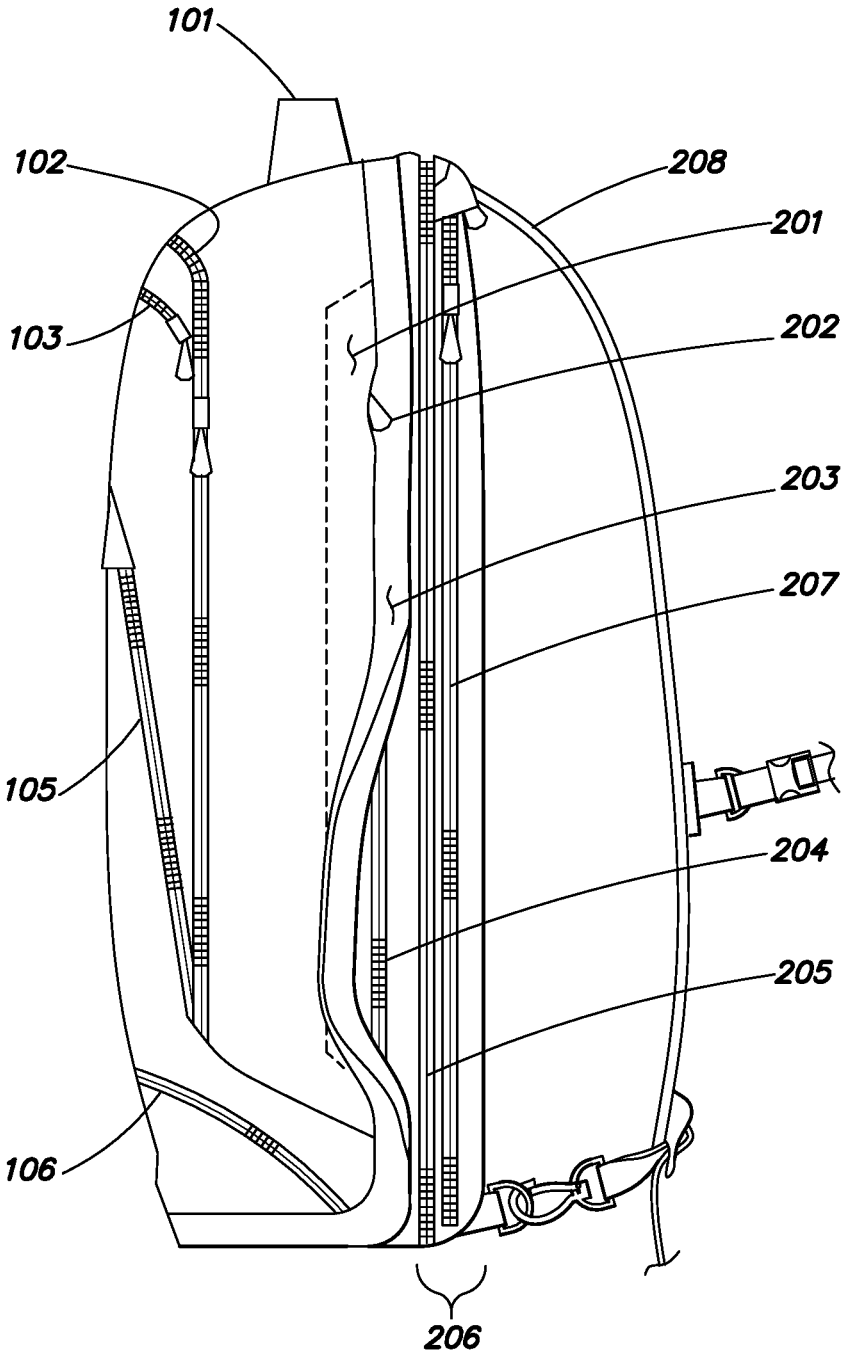
FIG. 2 is a side view of the pack in unexpanded condition.
Figure 3:
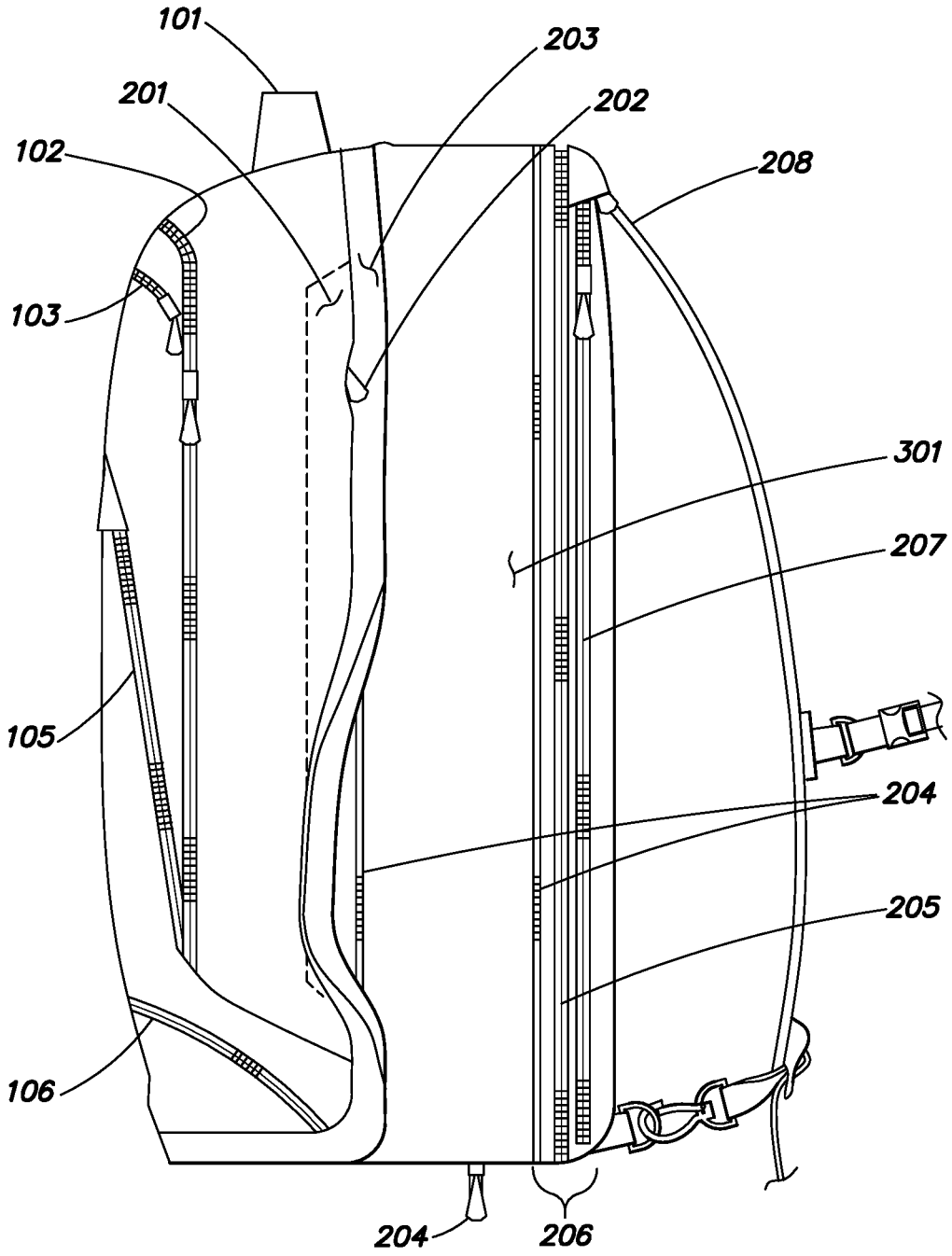
FIG. 3 is a side view of the pack in expanded condition.

The arrangements of these compartments and others is further illustrated in the side views of FIGS. 2 and 3. In addition to the compartment lids seen and described in connection with FIG. 1, FIG. 2 shows an optional flap 201 partially concealing a zipper having pull 202 showing and through which an interior pocket suitable for holding a water bottle, umbrella, or other similar-sized article is accessed, a second flap 203 partially concealing an expansion zipper 204, zipper 205 for opening suitcase-opening lid 206, and zipper 207 providing access to a compartment built into suitcase-opening lid 206 for holding a laptop computer or similar slim article. The compartment accessed through zipper 207 is essentially a padded slip-case built into the lid 206. Protective padding may be provided in the walls and seams of this construction to absorb minor impacts to a laptop computer carried therein, if desired.

Alternate embodiments may employ styles of lid or opening other than a suitcase-opening lid in place of the suitcase-opening lid 206 and zipper 205 illustrated. Any of the alternatives described including a U-shape opening, a slash-zipper opening (such as found on duffle bags, and which can be placed on a top surface or front surface of a pack), a drawstring opening, a flap closure (with optional buttons, snaps, buckles, straps, magnets, weights, etc.), and others could be used. Lids, openings, and fastenings can be combined, such as in the case of a drawstring opening covered by a flap with buckles. Such alternatives should preferably provide adequate access for packing into the compartment typical large travel items, such as folded clothing, shoes, and the like.

Figure 4:
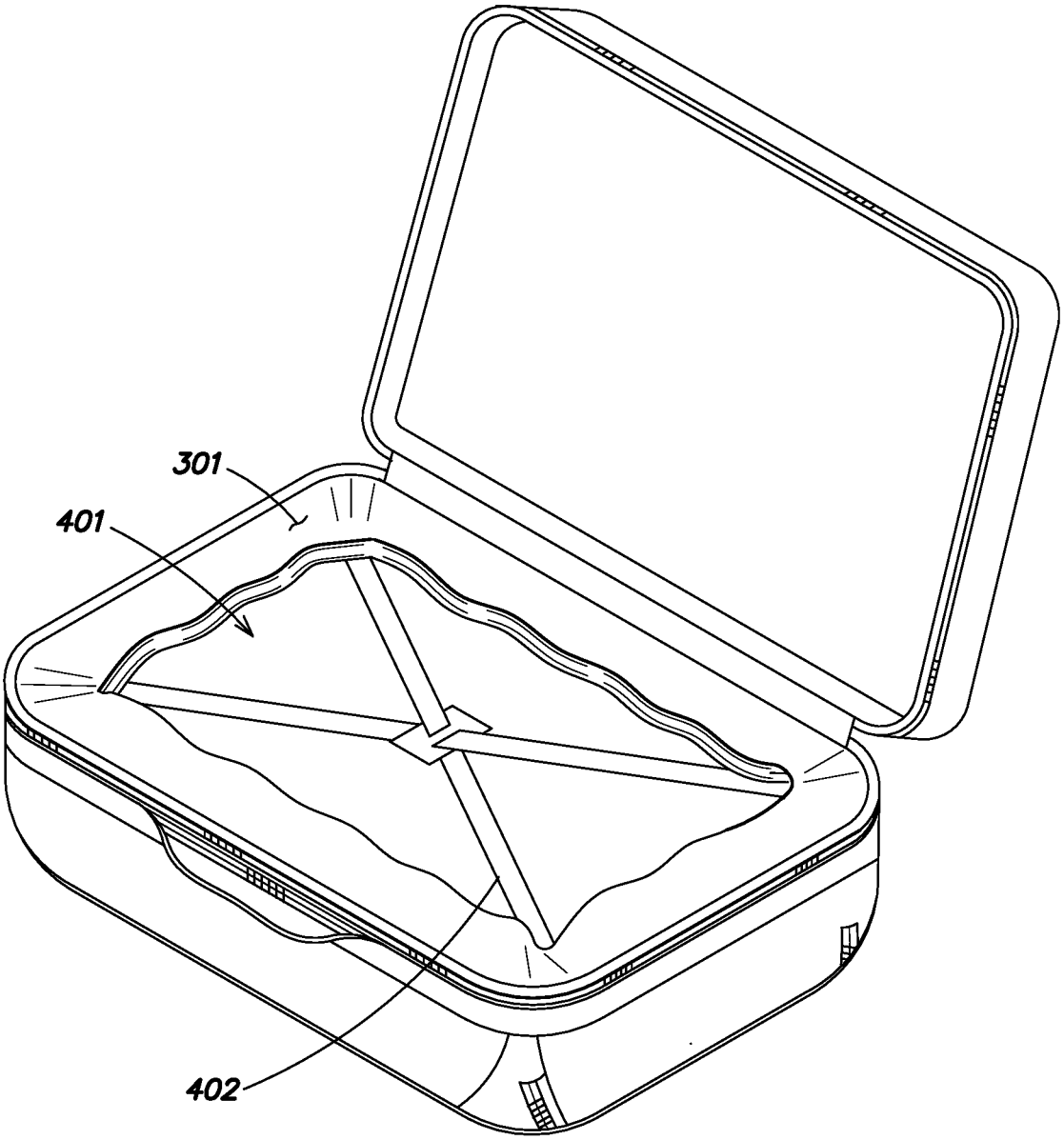
FIG. 4 is a perspective view of the pack in unexpanded condition, with the suitcase-opening lid to the travel items compartment open.
Figure 5:
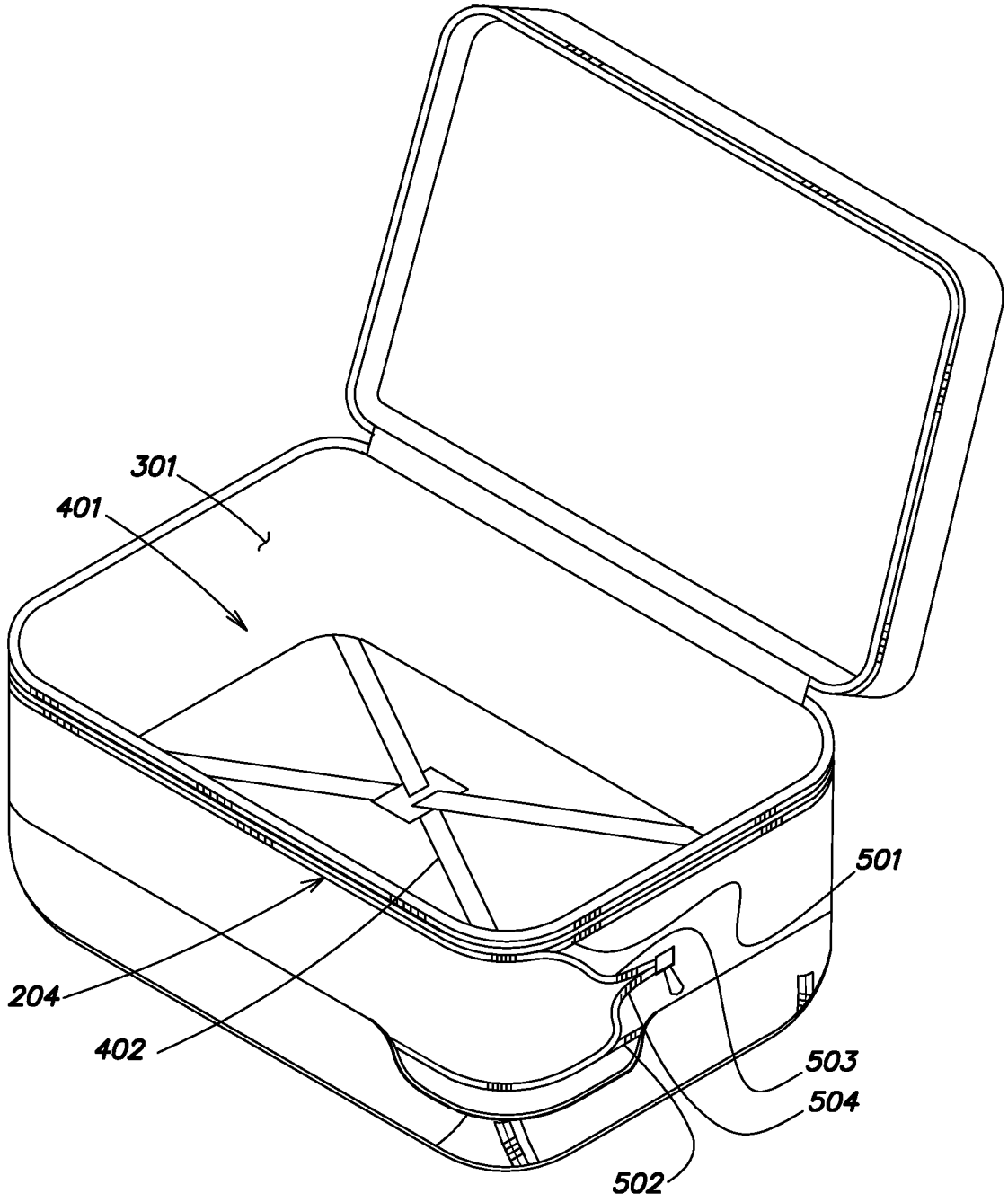
FIG. 5 is a perspective view of the pack in expanded condition, with the suitcase-opening lid open.

Expansion zipper 204 runs completely around the pack, as will be shown and described further in connection with FIGS. 3, 4 and 5. Zipper 205 runs three-quarters of the way around the pack, the fourth side forming a hinge, as will be shown and described further in connection with FIGS. 3, 4 and 5.

While FIG. 2 shows the pack with the expansion zipper 204 closed, FIG. 3 shows the pack with the expansion zipper 204 open. Opening the expansion zipper 204 permits the travel compartment accessible through the suitcase-opening lid 206 to be expanded from a compressed, empty condition, to an expanded condition having a substantial volume for travel items, such as clothing, toiletries, and other items. A flexible gusset 301 that runs around the pack between edges defined by the halves of the expansion zipper 204 forms the side walls of the travel compartment. Backpack straps 208 are attached to an outside wall of the suitcase opening lid.

Other expansion constructions can be used in place of expansion zipper 204 and gusset 301 can be used in alternative embodiments.

FIG. 3 clearly shows an arrangement of compartments stacked in an order from left to right in the Fig. (taken as equivalent to the corresponding reversed order) of: clam-shell-opening (personal items) compartment—expandable suitcase-opening (travel items) compartment—(built into the suitcase-opening lid) envelope-opening (computer) compartment. This arrangement has backpack straps attached to an outside wall of the suitcase opening lid, shown to the right of the FIG. An alternative arrangement (not shown) could have compartments stacked in an order from left to right (taken as equivalent to the corresponding reversed order) of: clamshell-opening (personal items) compartment—(built into a wall between the personal items and travel items compartments) envelope-opening through a side wall of the pack (computer) compartment—expandable suitcase-opening (travel items) compartment. This arrangement has backpack straps attached to an outside wall of the suitcase opening lid. Yet another configuration (not shown) could have compartments stacked in an order from left to right (taken as equivalent to the corresponding reversed order) of: top-opening (computer) compartment in lid of clamshell-opening (personal items) compartment—clam-shell opening (personal items) compartment—expandable suitcase-opening (travel items) compartment.

FIG. 4 shows the travel compartment 401 open, but in the compressed condition. The flexible gusset 301 in the compressed condition is folded into the travel compartment 401 so that the compartment has substantially no volume for carrying items when in the compressed condition. The travel compartment does include compression straps 402 for compressing clothing and other travel items into the travel compartment when it is expanded. This is shown in FIG. 5.

FIG. 5 shows the travel compartment 401 in expanded condition, now illustrating the substantial volume available for holding travel items, along with compression straps 402. Also seen in FIG. 5 is the configuration of expansion zipper 204 showing ends 501, 502, 503, and 504. When open, as seen in FIG. 5, ends 501 and 502 are separated, and not overlapped with ends 503 and 504 which remain unseparated.

Figure 6:
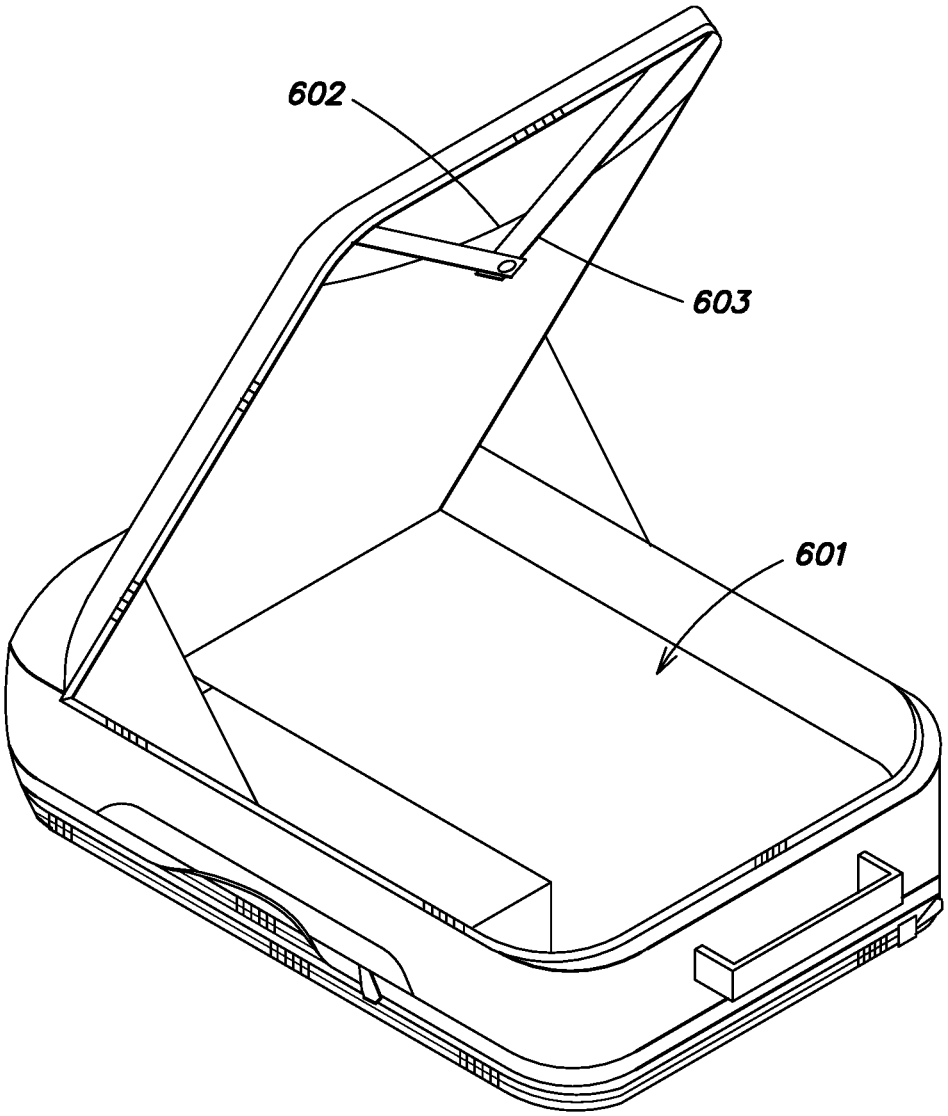
FIG. 6 is a perspective view of the pack in unexpanded condition, lying on the suitcase-opening lid (the back), and with the clamshell-opening lid to the personal items compartment open.

Taking the pack with the travel compartment 401 compressed, as shown in FIG. 4, closing the suitcase-opening lid 206, and flipping the pack onto the suitcase-opening lid 206 yields the view of FIG. 6. In FIG. 6, large zipper 102 is open, providing access to the main personal items compartment 601. In this exemplary pack, the pocket accessible through outside zipper 202 is seen encroaching into the interior of the main personal items compartment 601. In some alternative embodiments that pocket does not encroach (not shown) into the interior of the main personal items compartment 601. Main personal items compartment 601, in the exemplary embodiment includes an optional interior pocket 602 for tablet devices and an optional strap 603 for preventing a tablet stored in the pocket 602 from falling out of the pocket 602. In other embodiments, an interior mesh pocket can be built into the main personal items compartment 601, at the location where pocket 602 is shown. In such an embodiment, an optional tablet compartment (not shown) can be built into the wall between the personal items compartment 601 and the travel compartment 401, within the personal items compartment 601. Such an embodiment does not require, but can include, a restraining strap similar to optional strap 603.

Alternate embodiments may employ styles of opening other than the clamshell opening accessed through zipper 102 as shown. Any of the alternatives described including a U-shape opening, a slash-zipper opening (such as found on duffle bags, and which can be placed on a top surface or front surface of a pack), a drawstring opening, a flap closure (with optional buttons, snaps, buckles, straps, magnets, weights, etc.), and others could be used. Lids, openings, and fastenings can be combined, such as in the case of a drawstring opening covered by a flap with buckles. Such alternatives should preferably provide adequate access for packing into the compartment typical personal business items such as files, tablets, books, and the like.

Figure 7:
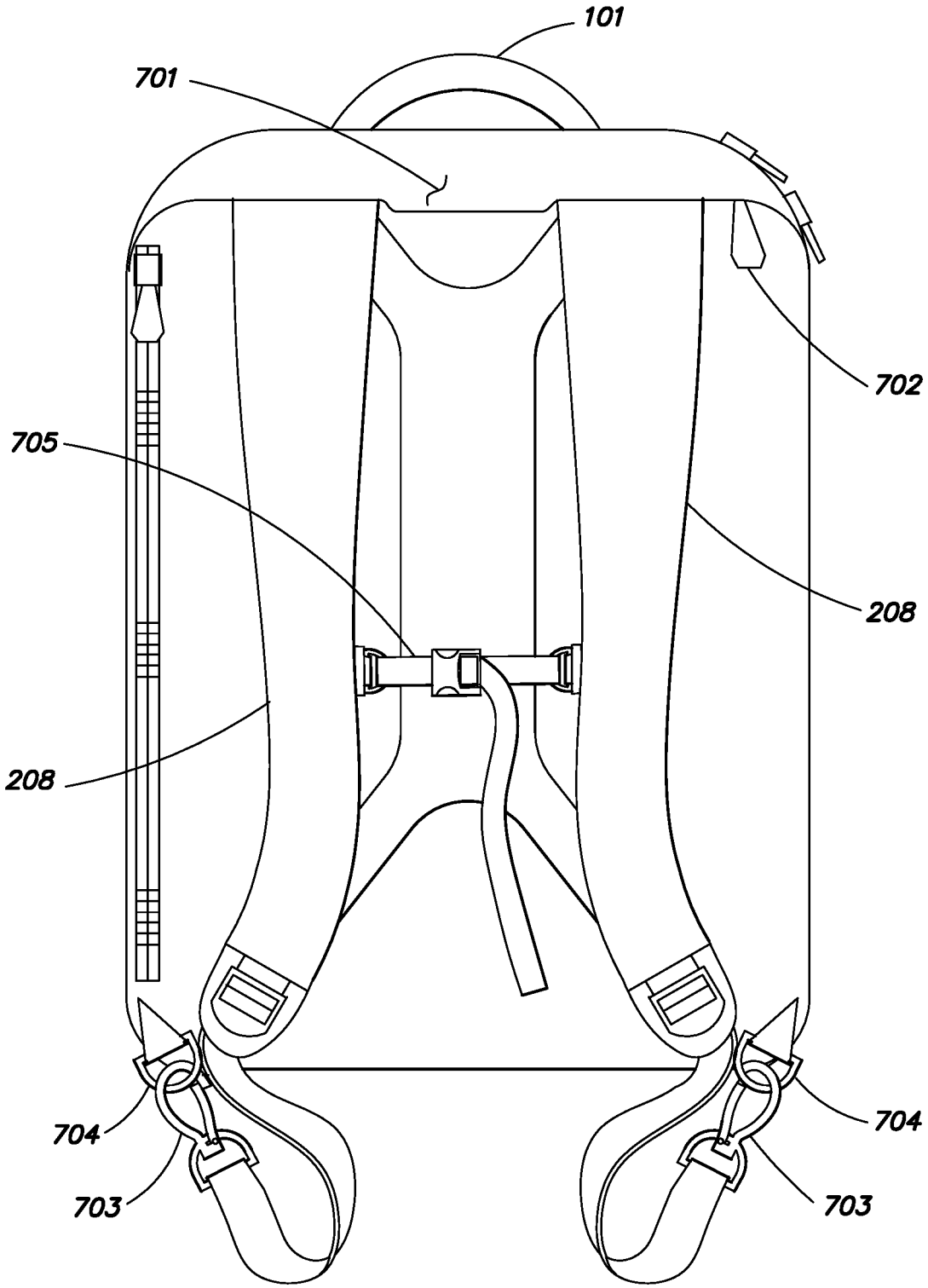
FIG. 7 is a back view showing the outer surface of the suitcase-opening lid, including backpack straps.

FIG. 7 shows several features best seen from the back of the pack. The pack may be carried as a backpack using backpack straps 208. Backpack straps 208 are sewn into a tuck-away pocket in the outer surface of the suitcase-opening lid. Access to the tuck-away pocket is beneath a rain flap 701, and through a zipper 702. One end of each of the straps 208 is attached near the top of the pocket, so the straps 208 can be stored within the tuck-away pocket when not in use. The other end of each of the straps 208 terminates in a clip 703 which can be attached to a D-ring 704 sewn to the pack or detached from the D-ring 704 so the strap 208 can be stowed in the pocket. Straps 208 may further include a sternum strap 705, and the outer surface of the pocket for stowing the straps may be padded to increase the comfort of the user when the pack is carried as a backpack.

What is claimed is:

1. A single-bag pack, comprising:

a back panel configured to fit against a back of individual;

a harness attached to the back panel and configured to fit a shoulder of an individual to support the pack on the back of the individual;

a computer compartment defined by a first substantially rectangular space formed between the back panel, a first wall, and a first section of exterior material between the back panel and the first wall;

a first zipper in the first section of exterior material forming a first zippered opening into the computer compartment to facilitate insertion and removal of a laptop computer through the first zippered opening;

an expandable travel compartment defined by a second substantially rectangular space having first and second long edges and two short edges and formed between the first wall, a second wall, and a second section of exterior material between the first wall and the second wall;

a second zipper in the second section of exterior material along the first long edge and the two short edges of the expandable travel compartment and forming a second zippered opening into the expandable travel compartment, such that when the second zipper is closed the expanded travel compartment is closed, and when the second zipper is fully opened the second long edge forms a hinge such that the second zippered opening forms a suitcase-opening lid and the expandable travel compartment is directly accessible through the second zippered opening;

an expansion zipper in the second section of the exterior material, wherein the expansion zipper has a first side connected between a first part of the second section of the exterior material and a first edge of an expandable gusset, and wherein the expansion zipper has a second side connected to a second part of the second section of the exterior material and a second edge of the expandable gusset, wherein the expansion zipper extends completely around the pack, and wherein the expandable gusset has a width and forms a loop extending completely around the pack between the first and second sides of the expansion zipper, such that when the expansion zipper is closed the expandable gusset and expandable travel compartment are compressed, and when the expansion zipper is fully opened the expandable gusset and the expandable travel compartment are expanded the width of the expandable gusset such that the expandable gusset forms interior and exterior sides of the expandable travel compartment;

wherein the second zipper is in the first part of the second section of exterior material nearest the first wall such that the suitcase-opening lid includes the back panel, the computer compartment, and the harness;

a personal items compartment defined by a third substantially rectangular space formed between the second wall, a third wall, and a third section of exterior material between the second wall and the third wall; and a third zipper in the third section of exterior material forming a third zippered opening into the personal items compartment.

2. The single-bag pack of claim 1, further comprising a flap of material beneath which the expansion zipper is hidden when the expansion zipper is closed.

3. The single-bag pack of claim 1, wherein the second zipper can be opened when the travel compartment is compressed.

4. The single-bag pack of claim 1, further comprising a tuck-away compartment in the suitcase-opening lid into which the harness can be tucked.

5. The single-bag pack of claim 1, further comprising an accessory compartment in a base of the pack and having a bottom zipper in the exterior material for directly accessing the accessory compartment.

6. The single-bag pack of claim 1, wherein the gusset comprises a liner material facing inside the expandable travel compartment and an exterior material facing outside of the pack.

7. The single-bag pack of claim 6, wherein the computer compartment comprises protective padding inside the computer compartment to form a padded slip case.

8. The single-bag pack of claim 7, wherein the first zippered opening for the computer compartment is formed solely along a vertical side of the single-bag pack.

9. The single-bag pack of claim 8, wherein the personal items compartment has two long sides, a first short side, and a second short side along a bottom of the pack, and wherein the third zipper extends along the two long sides and the first short side, such that when the third zipper is fully opened the second short side forms a hinge such that the third zippered opening forms a clam-shell opening lid including the front panel.

10. A single-bag pack, comprising:

a back panel configured to fit against a back of individual;

a computer compartment defined by a first substantially rectangular space formed between the back panel, a first wall, and a first section of exterior material between the back panel and the first wall;

a first zipper in the first section of exterior material forming a first zippered opening into the computer compartment to facilitate insertion and removal of a laptop computer through the first zippered opening;

an expandable travel compartment defined by a second substantially rectangular space formed between the first wall, a second wall, and a second section of exterior material connected between the first wall and the second wall, and having first and second long edges and two short edges;

a second zipper in the second section of exterior material along the first long edge and the two short edges of the expandable travel compartment and forming a second zippered opening into the expandable travel compartment, such that when the second zipper is closed the expanded travel compartment is closed, and when the second zipper is fully opened the second long edge forms a hinge such that the second zippered opening forms a suitcase-opening lid and the expandable travel compartment is directly accessible through the second zippered opening;

an expansion zipper in the second section of the exterior material, wherein the expansion zipper has a first side connected between a first part of the second section of the exterior material and a first edge of an expandable gusset, and wherein the expansion zipper has a second side connected to a second part of the second section of the exterior material and a second edge of the expandable gusset, wherein the expansion zipper extends completely around the pack, and wherein the expandable gusset has a width and forms a loop extending completely around the pack between the first and second sides of the expansion zipper, such that when the expansion zipper is closed the expandable gusset and expandable travel compartment are compressed, and when the expansion zipper is fully opened the expandable gusset and the expandable travel compartment are expanded the width of the expandable gusset such that the expandable gusset forms interior and exterior sides of the expandable travel compartment;

a personal items compartment defined by a third substantially rectangular space formed between the second wall, a third wall, and a third section of exterior material between the second wall and the third wall;

a third zipper in the third section of exterior material forming a third zippered opening into the personal items compartment; and an additional compartment defined by a space formed between the third wall and a front panel of exterior material connected to the third wall, and having a fourth zipper in the front panel forming a fourth zippered opening into the additional compartment.

11. The single-bag pack of claim 10, further comprising:

a harness attached to the back panel and configured to fit a shoulder of an individual to support the pack on the back of the individual.

12. The single-bag pack of claim 11, wherein the second zipper is in the first part of the second section of exterior material nearest the first wall to form the suitcase-opening lid such that the suitcase-opening lid includes the back panel, the computer compartment, and the harness.

13. The single-bag pack of claim 12, further comprising a tuck-away compartment in the suitcase-opening lid into which the harness can be tucked.

14. The single-bag pack of claim 10, wherein the gusset comprises a liner material facing inside the expandable travel compartment and an exterior material facing outside of the pack.

15. The single-bag pack of claim 14, wherein the computer compartment comprises protective padding inside the computer compartment to form a padded slip case.

16. The single-bag pack of claim 15, wherein the first zippered opening for the computer compartment is formed solely along a vertical side of the single-bag pack.

17. The single-bag pack of claim 16, wherein the personal items compartment has two long sides, a first short side, and a second short side along a bottom of the pack, and wherein the third zipper extends along the two long sides and the first short side, such that when the third zipper is fully opened the second short side forms a hinge such that the third zippered opening forms a clam-shell opening lid including the front panel.

18. The single-bag pack of claim 10, further comprising a flap of material beneath which the expansion zipper is hidden when the expansion zipper is closed.

19. The single-bag pack of claim 10, wherein the second zipper can be fully opened when the travel compartment is compressed.

20. The single-bag pack of claim 10, further comprising an accessory compartment in a base of the pack and having a bottom zipper in the exterior material for directly accessing the accessory compartment.

* * * * *